US012104798B2

(12) United States Patent
Suenaga

(10) Patent No.: US 12,104,798 B2
(45) Date of Patent: Oct. 1, 2024

(54) HEATING COOKING APPARATUS

(71) Applicant: SHARP KABUSHIKI KAISHA, Sakai (JP)

(72) Inventor: Hiromi Suenaga, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 18/236,938

(22) Filed: Aug. 22, 2023

(65) Prior Publication Data

US 2023/0392799 A1 Dec. 7, 2023

Related U.S. Application Data

(63) Continuation of application No. 17/631,375, filed as application No. PCT/JP2020/028884 on Jul. 28, 2020, now Pat. No. 11,774,112.

(30) Foreign Application Priority Data

Jul. 31, 2019 (JP) ..... 2019-141446

(51) Int. Cl.
*F24C 15/32* (2006.01)
*F24C 7/08* (2006.01)

(52) U.S. Cl.
CPC ..... *F24C 15/325* (2013.01); *F24C 7/085* (2013.01)

(58) Field of Classification Search
CPC ... H05B 6/6408; H05B 6/6485; F24C 15/325; F24C 7/067; F24C 7/085
See application file for complete search history.

(56) References Cited

U.S. PATENT DOCUMENTS

2002/0063126 A1* 5/2002 Kim ..... H05B 6/6476 219/757
2010/0303985 A1* 12/2010 De' Longhi ..... A47J 43/046 219/400
2015/0000539 A1* 1/2015 Tcaciuc ..... F24C 15/325 99/447

* cited by examiner

*Primary Examiner* — Thien S Tran
(74) *Attorney, Agent, or Firm* — ScienBiziP, P.C.

(57) ABSTRACT

A heating cooking apparatus includes a heating cooking chamber and a first air sending unit. The heating cooking chamber includes an accommodation space that accommodates an object to be heated, and a first space that communicates with the accommodation space. The first air sending unit includes a first partitioning member positioned between the first space and a first air sending chamber, a first suction hole portion disposed in the first partitioning member and configured to suction air inside the heating cooking chamber, and a first blow-out hole portion disposed in the first partitioning member and configured to blow air into the heating cooking chamber. The accommodation space is a space that can accommodate the object to be heated and has a predetermined capacity. The first space indicates a space into which the object to be heated is prohibited from entering.

3 Claims, 10 Drawing Sheets

HEATING COOKING APPARATUS

The present invention relates to a heating cooking apparatus. The present application is a continuation application of U.S. patent application Ser. No. 17/631,375, filed on Jan. 28, 2022, which is the National Stage of International Application No. PCT/JP2020/028884, filed on Jul. 28, 2020, which claims priority from Japanese Patent Application No. 2019-141446, filed on Jul. 31, 2019, the content of which is hereby incorporated by reference into this application.

TECHNICAL FIELD

Background Art

PTL 1 discloses a pull-out heating cooking apparatus. The pull-out heating cooking apparatus disclosed in PTL 1 includes a heating cooking apparatus main body and a pull-out body. The heating cooking apparatus main body includes a heating cooking chamber. The pull-out body can be drawn toward the outside of the heating cooking apparatus main body from a state where the pull-out body is accommodated in the heating cooking chamber.

Heating functions of the pull-out heating cooking apparatus disclosed in PTL 1 include a microwave heating function and a rapid hot air heating function. The microwave heating function is a function of applying microwaves toward an object to be heated. The rapid hot air heating function is a function of blowing out hot air from a top blow-out port and a side blow-out port toward an object to be heated. The top blow-out port is formed in a top wall of the heating cooking chamber. The side blow-out port is formed in a left side wall of the heating cooking chamber.

CITATION LIST

Patent Literature

PTL 1: JP 2010-133634 A

SUMMARY OF INVENTION

Technical Problem

Further, in recent years, there has been a demand for effective convection of hot air in a heating cooking chamber.

In light of the above problem, an object of the present invention is to provide a heating cooking apparatus that can effectively circulate hot air by convection in a heating cooking chamber.

Solution to Problem

A heating cooking apparatus of the present invention includes a heating cooking chamber and a first air sending unit. The heating cooking chamber includes an accommodation space for accommodating an object to be heated, and a first space that communicates with the accommodation space. The first air sending unit supplies first hot air to the heating cooking chamber. The first air sending unit includes a first air sending chamber, a first partitioning member positioned between the first space and the first air sending chamber, a first suction hole portion disposed in the first partitioning member and configured to suction air inside the heating cooking chamber, and a first blow-out hole portion disposed in the first partitioning member and configured to blow air into the heating cooking chamber. The accommodation space is a space capable of accommodating the object to be heated and has a predetermined capacity. The first space indicates a space into which the object to be heated is prohibited from entering.

Advantageous Effects of Invention

According to the heating cooking apparatus of the present invention, hot air can be effectively circulated by convection in a heating cooking chamber.

DESCRIPTION OF EMBODIMENTS

Figure 1:
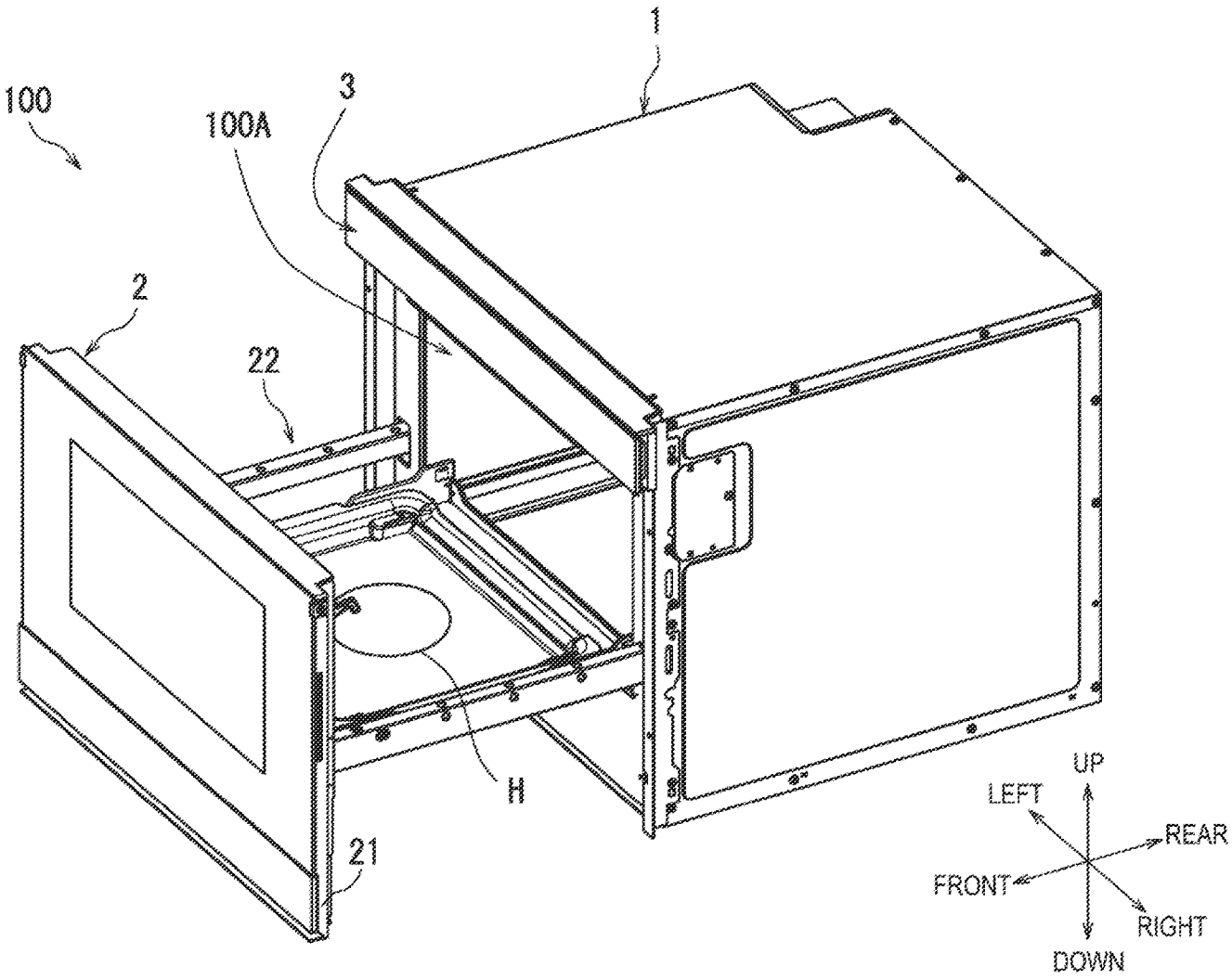
FIG. 1 is a perspective view illustrating an appearance of a pull-out heating cooking apparatus according to an embodiment of the present invention.

Hereinafter, an embodiment of a pull-out heating cooking apparatus according to the present invention will be described with reference to the drawings. In the drawings, the same or equivalent components are denoted by the same reference signs and description thereof will not be repeated.

Figure 2:
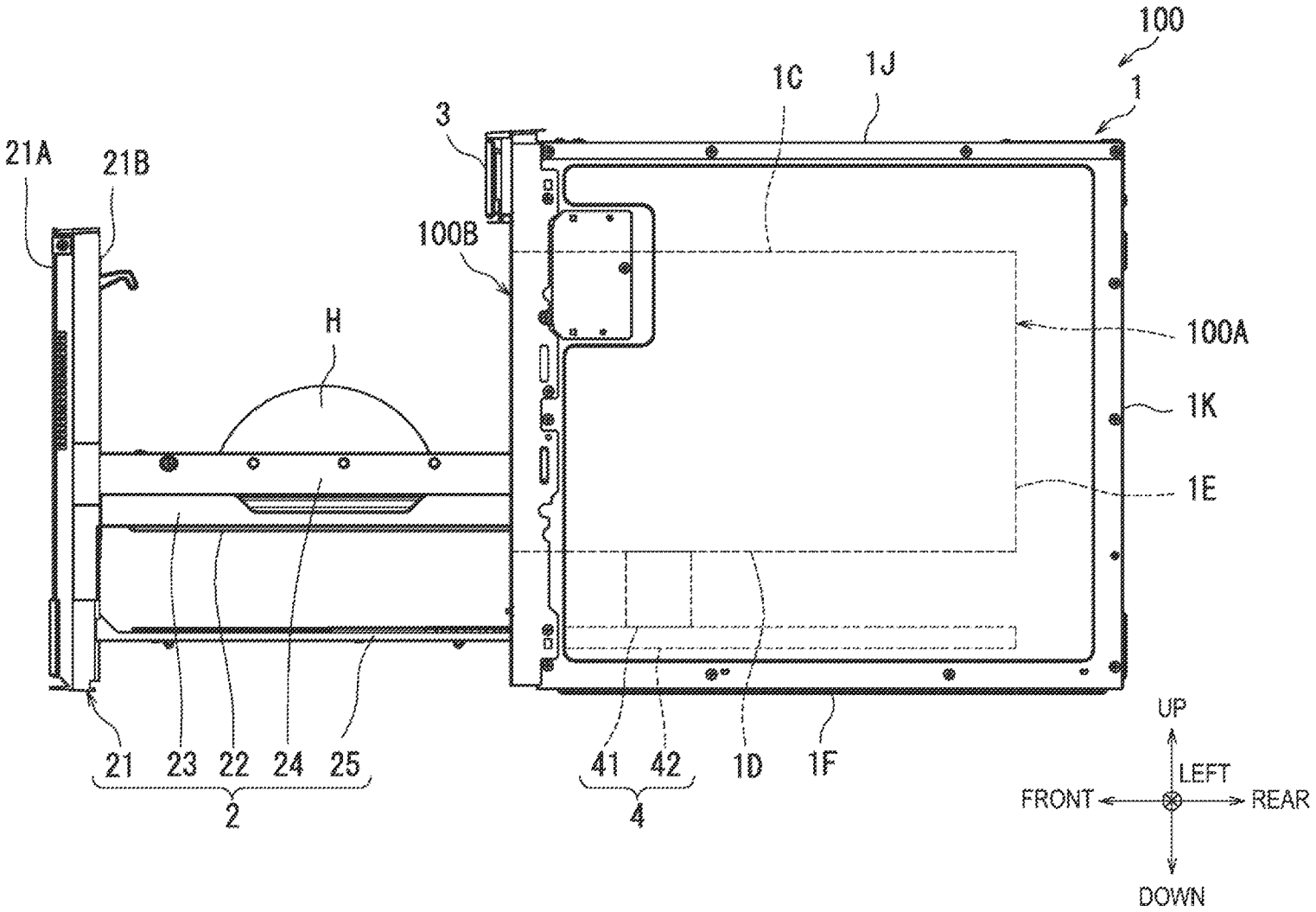
FIG. 2 is a right side view illustrating the pull-out heating cooking apparatus according to the present embodiment.
Figure 3:
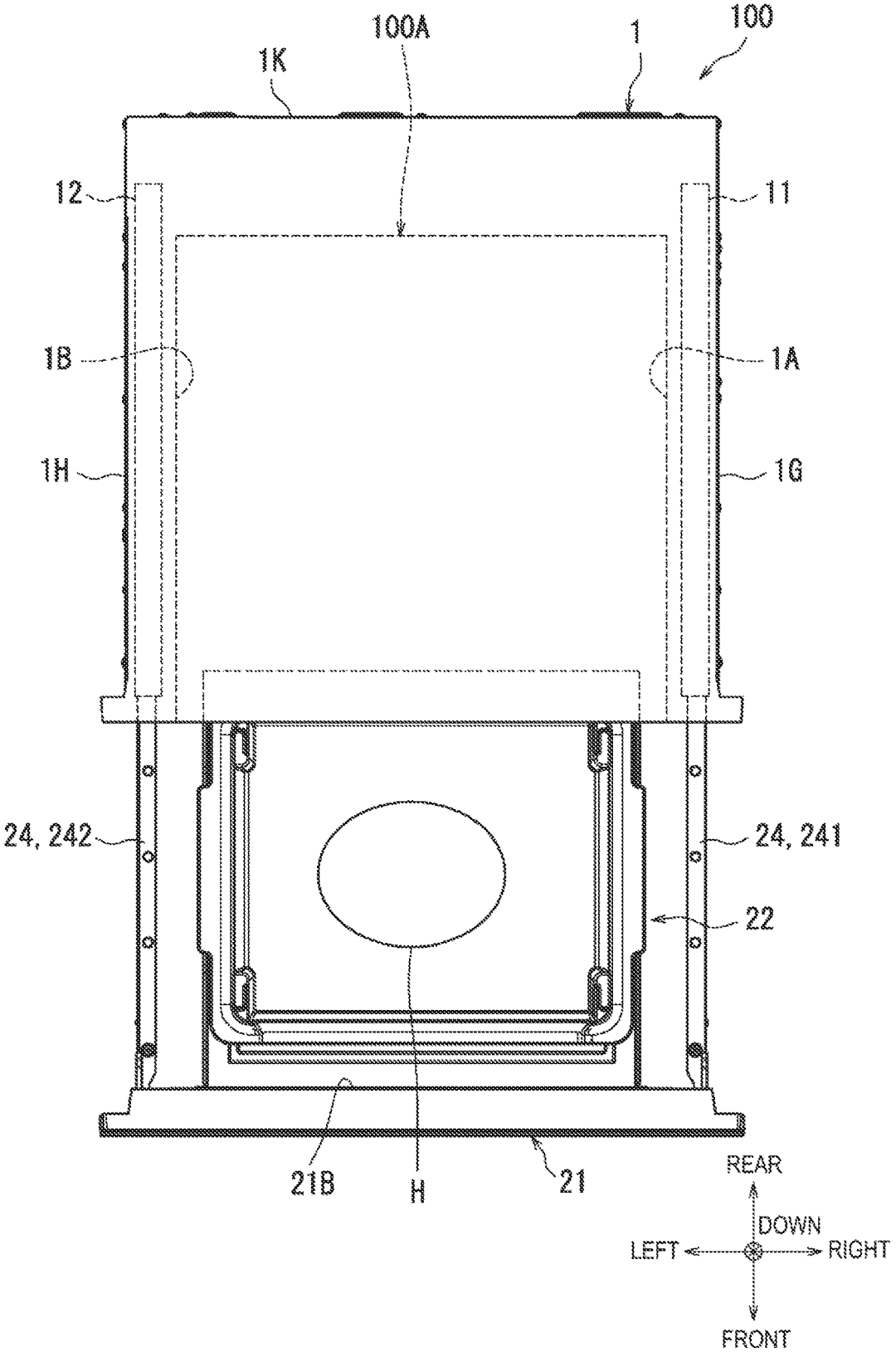
FIG. 3 is a top view illustrating the pull-out heating cooking apparatus according to the present embodiment.

A pull-out heating cooking apparatus 100 according to the present embodiment will be described with reference to FIG. 1 to FIG. 3. FIG. 1 is a perspective view illustrating an appearance of the pull-out heating cooking apparatus 100 according to the present embodiment. FIG. 2 is a right side view illustrating the pull-out heating cooking apparatus 100 according to the present embodiment. FIG. 3 is a top view illustrating the pull-out heating cooking apparatus 100 according to the present embodiment. More specifically, FIG. 1 to FIG. 3 illustrate the pull-out heating cooking apparatus 100 in a state where a pull-out body 2 is pulled out. Further, FIG. 1 illustrates the appearance of the pull-out heating cooking apparatus 100 when viewed from above obliquely from the right. The pull-out heating cooking apparatus 100 is one example of a heating cooking apparatus.

The pull-out heating cooking apparatus 100 heats and cooks an object H to be heated. The object H to be heated is, for example, a food product. As illustrated in FIG. 1, the pull-out heating cooking apparatus 100 includes a heating chamber 1, the pull-out body 2, and an operation panel 3.

In the present embodiment, a side on which the operation panel 3 of the pull-out heating cooking apparatus 100 is disposed is defined as a front side of the pull-out heating cooking apparatus 100, and a side opposite to the front side is defined as a rear side of the pull-out heating cooking apparatus 100. Further, a right side of the pull-out heating cooking apparatus 100 when the pull-out heating cooking apparatus 100 is viewed from the front side is defined as a right side, and a side opposite to the right side is defined as a left side of the pull-out heating cooking apparatus 100. Further, in a direction orthogonal to a front-rear direction and a left-right direction of the pull-out heating cooking apparatus 100, a side on which the operation panel 3 is disposed is defined as an upper side of the pull-out heating cooking apparatus 100, and a side opposite to the upper side is defined as a lower side of the pull-out heating cooking apparatus 100. Note that these orientations do not limit the orientation of the pull-out heating cooking apparatus according to the present invention when in use.

As illustrated in FIG. 1 to FIG. 3, the heating chamber 1 is a box-like member. Specifically, the heating chamber 1 includes a right outer wall 1G, a left outer wall 1H, a top outer wall 1J, a bottom outer wall 1F, and a back outer wall 1K. The heating chamber 1 also includes a heating cooking chamber 100A therein.

The heating cooking chamber 100A accommodates the object H to be heated. Specifically, the heating cooking chamber 100A includes a right wall 1A, a left wall 1B, a top wall 1C, a bottom wall 1D, and a back wall 1E. The shape of the heating cooking chamber 100A is, for example, a substantially rectangular parallelepiped shape. Materials of the right wall 1A, the left wall 1B, the top wall 1C, the bottom wall 1D, and the back wall 1E are, for example, a metal. The heating cooking chamber 100A further includes an opening 100B that communicates with the outside of the heating cooking chamber 100A. More specifically, the front side of the heating cooking chamber 100A is opened to allow the object H to be heated to be inserted and removed.

The heating chamber 1 further includes a space between the bottom wall 1D and the bottom outer wall 1F. The heating chamber 1 further includes a space between the right wall 1A and the right outer wall 1G. The heating chamber 1 further includes a space between the left wall 1B and the left outer wall 1H. The heating chamber 1 further includes a space between the top wall 1C and the top outer wall 1J. The heating chamber 1 further includes a space between the back wall 1E and the back outer wall 1K.

The operation panel 3 includes an operation unit and a display portion. The operation unit receives an operation from a user. The operation unit includes various types of keys. The display portion displays various pieces of information. The display portion includes a liquid crystal panel. The operation panel 3 is located on an upper portion of a front face of the heating chamber 1.

The pull-out body 2 can be pulled out of and pushed into the heating chamber 1. Specifically, the pull-out body 2 includes a door portion 21, a placing portion 22, and a support portion 23. The door portion 21 can open and close an opening on the front side of the heating cooking chamber 100A. The door portion 21 is a substantially rectangular plate-like member. The door portion 21 includes a front face 21A and a rear face 21B. The door portion 21 opens the opening on the front side of the heating cooking chamber 100A in a state where the pull-out body 2 is pulled out of the heating cooking chamber 100A. The door portion 21 closes the opening on the front side of the heating cooking chamber 100A in a state where the pull-out body 2 is pulled into the heating cooking chamber 100A. In a state where the pull-out body 2 is pushed into the heating cooking chamber 100A, a distance between the top wall 1C and the bottom wall 1D is shorter than a distance between the back wall 1E and the rear face 21B.

The object H to be heated can be placed on the placing portion 22. The placing portion 22 is, for example, a plate-like member made of ceramic or glass. The support portion 23 is fixed to the rear face 21B of the door portion 21, and supports a peripheral portion of the placing portion 22 such that the placing portion 22 is held in a horizontal state. A material of the support portion 23 includes a metal. The placing portion 22 and the support portion 23 are pulled out of the heating cooking chamber 100A to the outside by pulling out the pull-out body 2. The placing portion 22 and the support portion 23 are accommodated in the heating cooking chamber 100A in a state where the pull-out body 2 is pulled in.

The pull-out body 2 further includes a pair of slide members 24 and a support member 25 in addition to the door portion 21, the support portion 23, and the placing portion 22.

The pair of slide members 24 regulate the movement direction of the pull-out body 2 in the front-rear direction. The pair of slide members 24 are fixed to the rear face 21B of the door portion 21.

Specifically, the pair of slide members 24 includes a right slide member 241 and a left slide member 242. Each of the right slide member 241 and the left slide member 242 is a member having the front-rear direction as a longitudinal direction. The right slide member 241 and the left slide member 242 face each other in the left-right direction. One end portion of the right slide member 241 is attached to a right edge portion of the rear face 21B of the door portion 21. One end portion of the left slide member 242 is attached to a left edge portion of the rear face 21B of the door portion 21.

Meanwhile, the heating chamber 1 further includes a right slide rail 11 and a left slide rail 12. The right slide rail 11 is fixed in a space between the right wall 1A and the right outer wall 1G. The left slide rail 12 is fixed in a space between the left wall 1B and the left outer wall 1H. Each of the right slide rail 11 and the left slide rail 12 is a member having the front-rear direction as a longitudinal direction. The right slide member 241 is supported to be slidable along the right slide rail 11. The left slide member 242 is supported to be slidable along the left slide rail 12.

Furthermore, the support member 25 supports the door portion 21. More specifically, the support member 25 regulates the movement direction of the pull-out body 2 in the front-rear direction. One end portion of the support member 25 is attached at a center portion in the left-right direction of the rear face 21B of the door portion 21 and below the placing portion 22. The support member 25 is a member having the front-rear direction as a longitudinal direction. The support member 25 includes a rack portion. The rack portion includes a plurality of teeth.

Meanwhile, the heating chamber 1 further includes a drive mechanism 4. The drive mechanism 4 is accommodated in a space between the bottom wall 1D and the bottom outer wall 1F. For example, the drive mechanism 4 includes a drive motor 41, a pinion, and a drive rail 42. The drive rail 42 is fixed in a space between the bottom wall 1D and the bottom outer wall 1F. The drive rail 42 is a member having the front-rear direction as a longitudinal direction. The support member 25 is supported to be slidable along the drive rail 42. The pinion is attached to a tip end portion of the drive motor 41. The pinion engages with the rack portion of the support member 25. Furthermore, the support member 25 moves in the front-rear direction when the pinion rotates. As the support member 25 moves in the front-rear direction, the pair of slide members 24 also move in the front-rear direction. As a result, the pull-out body 2 is in an open state or a closed state.

Figure 4:
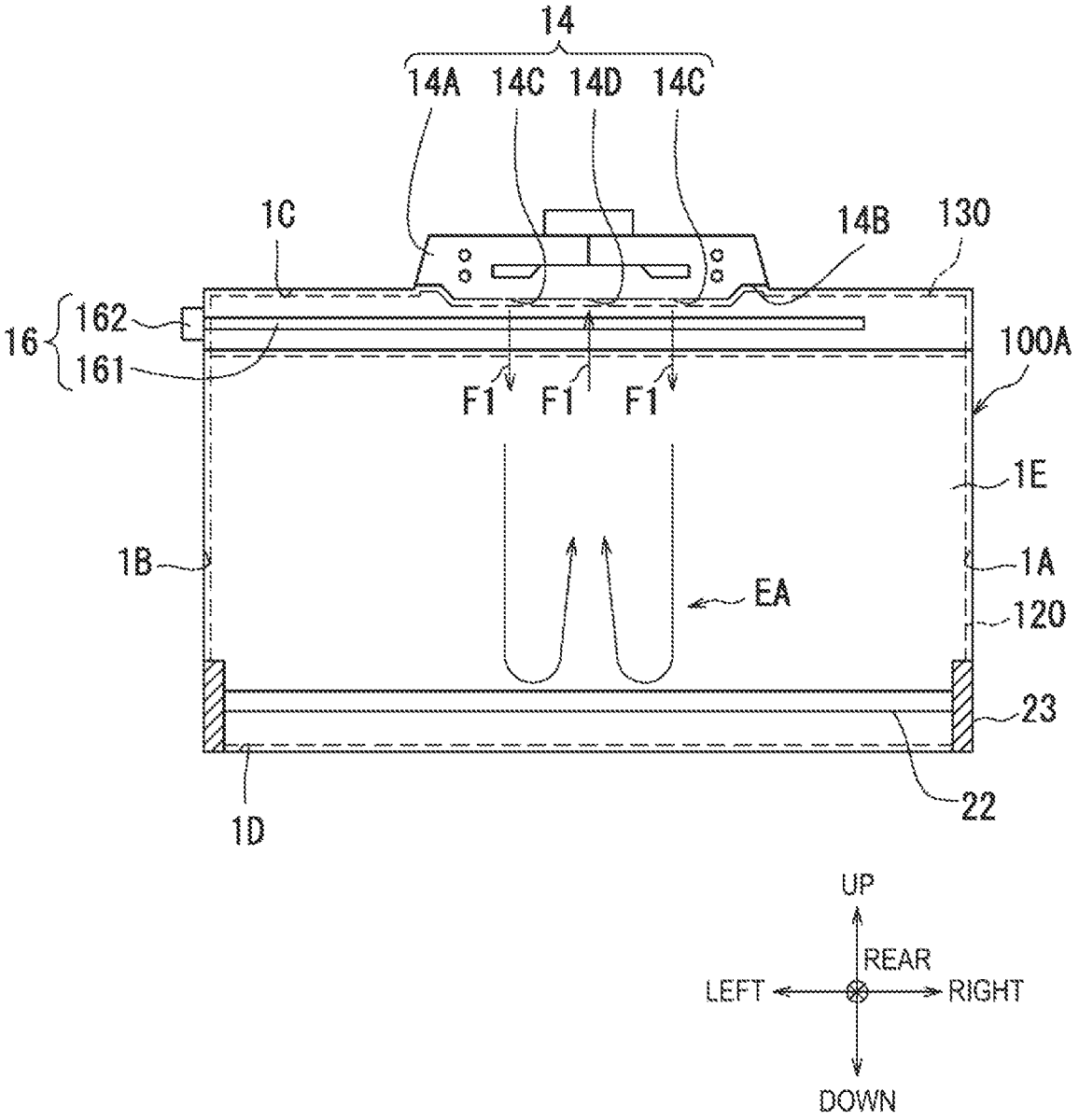
FIG. 4 is a diagram illustrating a schematic cross section of a heating cooking chamber according to the present embodiment.
Figure 5:
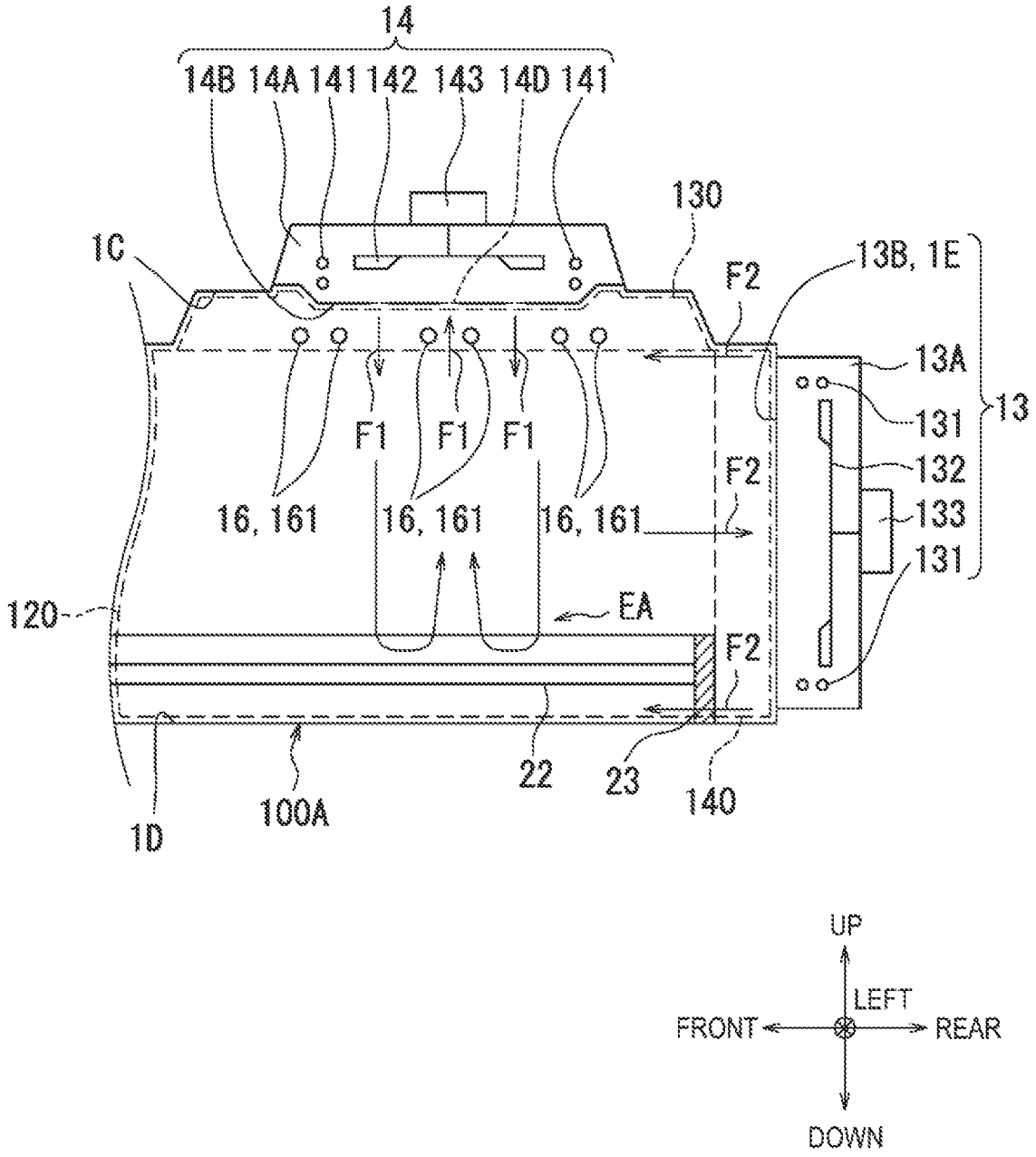
FIG. 5 is a diagram illustrating a schematic cross section of the heating cooking chamber according to the present embodiment.

Next, the heating cooking chamber 100A according to the present embodiment will be further described with reference to FIG. 1 to FIG. 5. FIG. 4 and FIG. 5 are diagrams illustrating a schematic cross section of the heating cooking chamber 100A according to the present embodiment. More specifically, FIG. 4 illustrates a cross section of the heating cooking chamber taken along a plane orthogonal to the front-rear direction. FIG. 5 illustrates a cross section of the heating cooking chamber taken along a plane orthogonal to the left-right direction.

As illustrated in FIG. 4 and FIG. 5, the pull-out heating cooking apparatus 100 further includes a first air sending unit 14. The first air sending unit 14 supplies a first hot air F1 to the heating cooking chamber 100A.

The first air sending unit 14 is positioned outside of the heating cooking chamber 100A via the top wall 1C. More specifically, the first air sending unit 14 includes a first partitioning member 14B, a first suction hole portion 14D, a first blow-out hole portion 14C, and a first air sending chamber 14A. The first air sending chamber 14A is, for example, a box-like member.

The first partitioning member 14B is, for example, a plate-like member made of a metal. The shape of the first partitioning member 14B is, for example, a square shape when viewed from the upper side to the lower side. The first partitioning member 14B is disposed in a substantially center portion of the top wall 1C.

The first suction hole portion 14D is disposed in the first partitioning member 14B and suctions air inside the heating cooking chamber 100A. The first blow-out hole portion 14C is disposed in the first partitioning member 14B and blows air into the heating cooking chamber 100A. More specifically, the first air sending unit 14 suctions the first hot air F1 from a predetermined region EA in the heating cooking chamber 100A and blows the first hot air F1 into a predetermined region EA in the heating cooking chamber 100A. The predetermined region EA is, for example, a center region within the heating cooking chamber 100A. A center portion of the object H to be heated is disposed in the predetermined region EA.

The heating cooking chamber 100A further includes an accommodation space 120 and a first space 130. The accommodation space 120 accommodates the object H to be heated. The accommodation space 120 is a space that can accommodate the object to be heated H and has a predetermined volume. The shape of the accommodation space 120 is, for example, a substantially rectangular parallelepiped shape. The first space 130 communicates with the accommodation space 120. The first space 130 indicates a space into which the object H to be heated is prohibited from entering. The first space 130 is preferably a space located above an upper end of the opening 100B of the heating cooking chamber 100A. The shape of the first space 130 is, for example, a substantially rectangular parallelepiped shape. The accommodation space 120 includes the predetermined region EA.

The first partitioning member 14B is positioned between the first space 130 and the first air sending chamber 14A. In other words, the first space 130 is positioned between the accommodation space 120 and the first air sending unit 14.

Here, flow of the first hot air F1 will be described in detail. First, the first hot air F1 is blown out to the first space 130 from the first blow-out hole portion 14C. The first hot air F1 blown out to the first space 130 moves downward. Thereafter, the first hot air F1 that has reached the peripheral region of the predetermined region EA moves, for example, toward the center region of the predetermined region EA and moves upward so that the movement direction of the first hot air F1 is reversed. The first hot air F1 moving upward moves within the first space 130. Thereafter, the first hot air F1 is suctioned from the first suction hole portion 14D.

According to the pull-out heating cooking apparatus 100 of the present invention, the first space 130 is positioned between the accommodation space 120 and the first air sending unit 14. Thus, circulation of the first hot air F1 is not inhibited. As a result, the first hot air F1 can be effectively circulated by convection within the heating cooking chamber 100A. Further, according to the pull-out heating cooking apparatus 100, the first suction hole portion 14D and the first blow-out hole portion 14C are located in the top wall 1C. As a result, a distance between the first suction hole portion 14D and the first blow-out hole portion 14C is reduced. Accordingly, the circulation path of the first hot air F1 is also reduced. Thus, the predetermined region EA within the heating cooking chamber 100A can be heated in a short period of time. Further, because the first space 130 is a space located above the upper end of the opening 100B of the heating cooking chamber 100A, the object H to be heated is not disposed in the first space 130.

Specifically, the first air sending unit 14 further includes a first heater 141, a first centrifugal fan 142, and a first drive unit 143.

The first heater 141 and the first centrifugal fan 142 are accommodated in the first air sending chamber 14A. The first heater 141 generates the first hot air F1 by heating air in the first air sending chamber 14A. Specifically, the shape of the first heater 141 is a circular ring when viewed from the upper side to the lower side. Further, the first heater 141 is disposed along the outer circumference of the first centrifugal fan 142.

The first drive unit 143 is positioned outside of the first air sending chamber 14A. The first drive unit 143 energizes the first heater 141 and drives the first centrifugal fan 142. The first drive unit 143 includes, for example, a motor and an energization unit.

Figure 6:
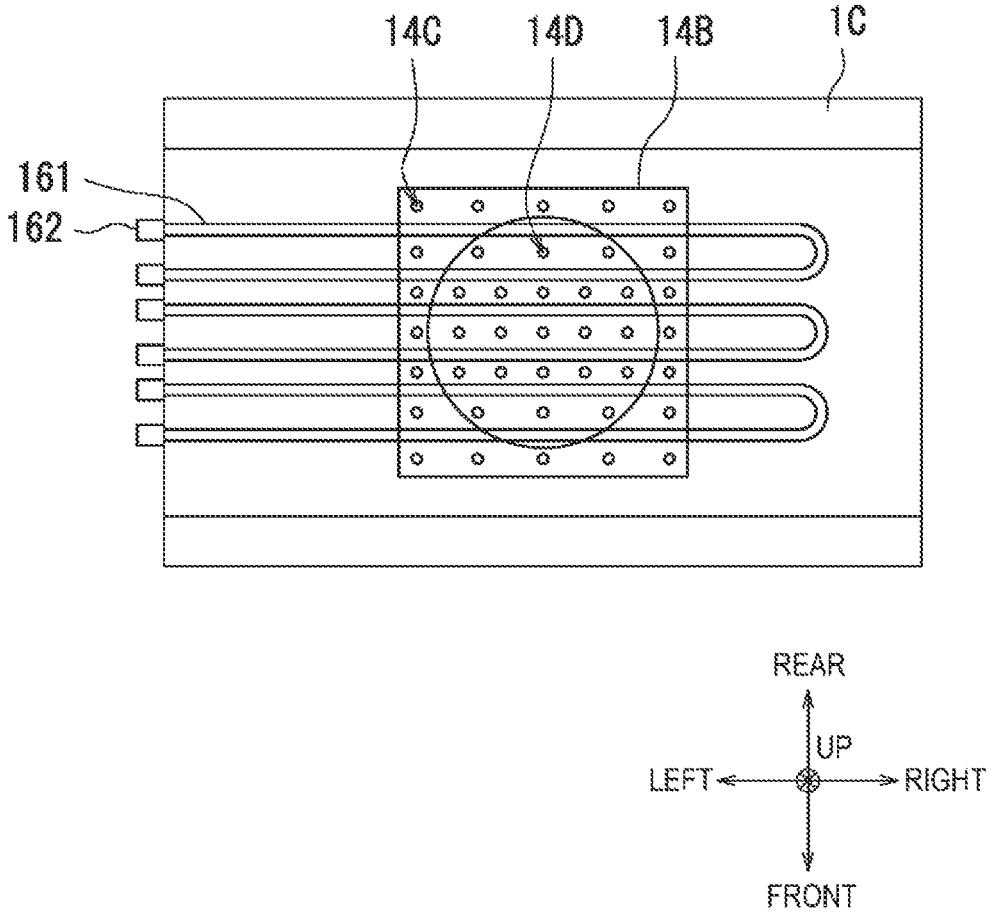
FIG. 6 is a diagram illustrating a first partitioning member according to the present embodiment.

Next, the first air sending unit 14 according to the present embodiment will be further described with reference to FIG. 1 to FIG. 6. FIG. 6 is a diagram illustrating the first partitioning member 14B according to the present embodiment.

As illustrated in FIG. 6, more specifically, the first suction hole portion 14D is, for example, a set of a plurality of punched holes. Similarly, the first blow-out hole portion 14C is, for example, a set of a plurality of punched holes. The punched holes each have, for example, a circular shape. The diameter of each of the punched holes of the first suction hole portion 14D and the first blow-out hole portion 14C is, for example, 3.4 mm. Thus, each of the first suction hole portion 14D and the first blow-out hole portion 14C has a small size. As a result, it is possible to prevent a tool or the like from being caught in the first suction hole portion 14D and the first blow-out hole portion 14C when the heating cooking chamber 100A is cleaned.

More specifically, the first blow-out hole portion 14C surrounds the first suction hole portion 14D. Specifically, the first suction hole portion 14D is positioned at the center portion of the first partitioning member 14B. The set of the plurality of punched holes of the first suction hole portion 14D has, for example, a circular shape. On the other hand, the first blow-out hole portion 14C is formed along the outer circumference of the first suction hole portion 14D. The set of the plurality of punched holes of the first blow-out hole portion 14C has, for example, an annular shape.

According to the pull-out heating cooking apparatus 100 of the present invention, the first blow-out hole portion 14C surrounds the first suction hole portion 14D, and thus it is possible to more uniformly heat the predetermined region EA in the heating cooking chamber 100A.

The first centrifugal fan 142 opposes the first space 130 through the first partitioning member 14B. The first suction hole portion 14D opposes the first centrifugal fan 142.

Figure 7:
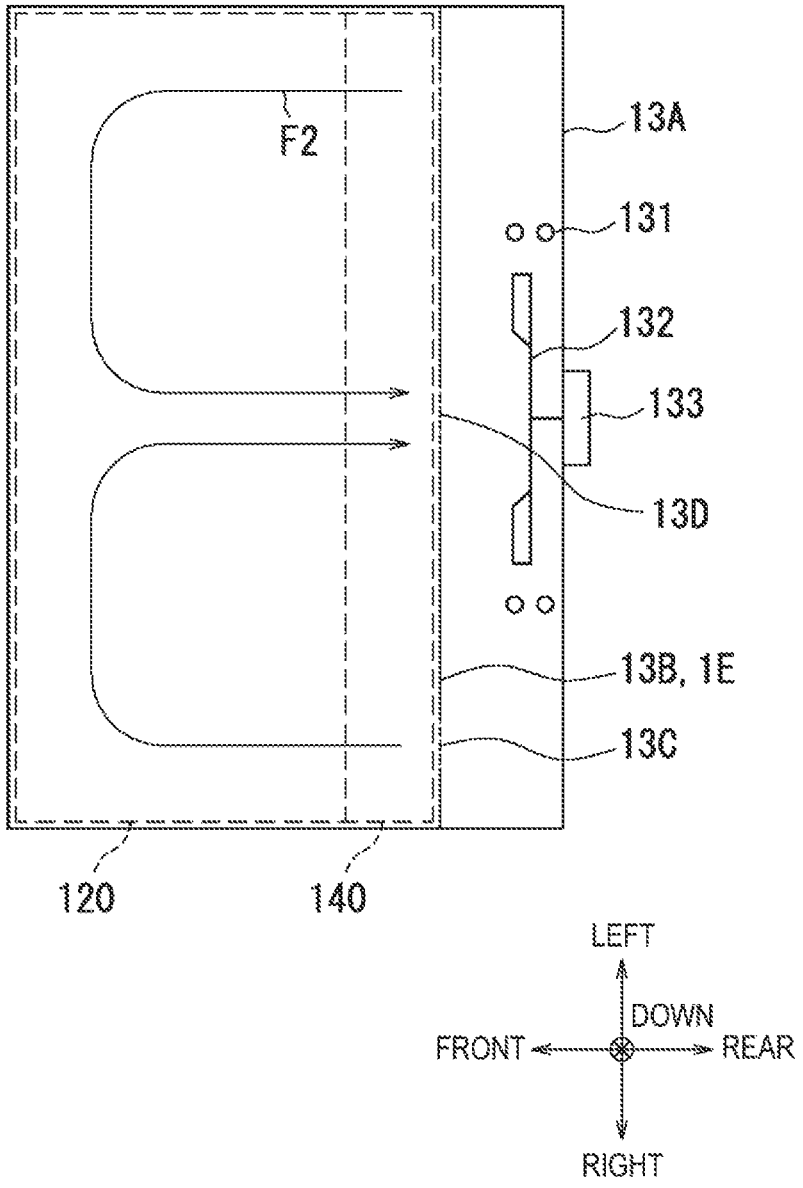
FIG. 7 is a diagram illustrating a schematic cross section of the heating cooking chamber according to the present embodiment.

Next, the heating cooking chamber 100A according to the present embodiment will be further described. FIG. 7 is a diagram illustrating a schematic cross section of the heating cooking chamber 100A according to the present embodiment. More specifically, FIG. 7 illustrates a cross section of the heating cooking chamber taken along a plane orthogonal to an up-down direction.

As illustrated in FIG. 5 and FIG. 7, the pull-out heating cooking apparatus 100 further includes a second air sending unit 13. The second air sending unit 13 supplies a second hot air F2 to the heating cooking chamber 100A.

The second air sending unit 13 is positioned outside of the heating cooking chamber 100A via the back wall 1E. More specifically, the second air sending unit 13 includes a second partitioning member 13B, a second suction hole portion 13D, a second blow-out hole portion 13C, and a second air sending chamber 13A. The second air sending chamber 13A is, for example, a box-like member. The size of the second air sending chamber 13A is smaller than the size of the first air sending chamber 14A.

The second partitioning member 13B is, for example, a plate-like member made of a metal. The shape of the second partitioning member 13B is, for example, a rectangular shape when viewed from the front side to the rear side. The second partitioning member 13B is disposed on substantially the entire surface of the back wall 1E.

The second suction hole portion 13D is disposed in the second partitioning member 13B and suctions air inside the heating cooking chamber 100A. The second blow-out hole portion 13C is disposed in the second partitioning member 13B and blows air into the heating cooking chamber 100A.

The heating cooking chamber 100A further includes a second space 140. The second space 140 communicates with the accommodation space 120. The second space 140 indicates a space into which the object H to be heated is prohibited from entering. The shape of the second space 140 is, for example, a substantially rectangular parallelepiped shape. The second space 140 is preferably a space located behind the rear end of the support portion 23.

The second partitioning member 13B is positioned between the second space 140 and the second air sending chamber 13A. In other words, the second space 140 is positioned between the accommodation space 120 and the second air sending unit 13.

Now, the flow of the second hot air F2 will be described in detail. First, the second hot air F2 is blown into the second space 140 from the second blow-out hole portion 13C. The second hot air F2 blown into the second space 140 mainly moves forward along the right wall 1A and the left wall 1B. Thereafter, the second hot air F2 that has reached the rear face 21B of the door portion 21 moves backward so that the movement direction of the second hot air F2 is reversed. Then, the second hot air F2 that has reached the object H to be heated moves backward along the object H to be heated. The second hot air F2 moving backward moves within the second space 140. Thereafter, the second hot air F2 is suctioned from the second suction hole portion 13D.

According to the pull-out heating cooking apparatus 100 of the present invention, the second space 140 is positioned between the accommodation space 120 and the second air sending unit 13. Thus, the circulation of the second hot air F2 is not inhibited. As a result, the second hot air F2 can be effectively circulated by convection within the heating cooking chamber 100A.

Specifically, the second air sending unit 13 further includes a second heater 131, a second centrifugal fan 132, and a second drive unit 133.

The second heater 131 and the second centrifugal fan 132 are accommodated in the second air sending chamber 13A. The second heater 131 heats air in the second air sending chamber 13A to generate the second hot air F2. Specifically, the shape of the second heater 131 is a circular ring when viewed from the front side to the rear side. Further, the second heater 131 is disposed along the outer circumference of the second centrifugal fan 132.

The second drive unit 133 is positioned outside of the second air sending chamber 13A. The second drive unit 133 energizes the second heater 131 and drives the second centrifugal fan 132. In the present embodiment, the second drive unit 133 drives the second centrifugal fan 132 so that the rotation speed of the first centrifugal fan 142 is different from the rotation speed of the second centrifugal fan 132. More specifically, the second drive unit 133 drives the second centrifugal fan 132 so that the rotation speed of the first centrifugal fan 142 becomes higher than the rotation speed of the second centrifugal fan 132. The second drive unit 133 includes, for example, a motor and an energization unit.

Figure 8:
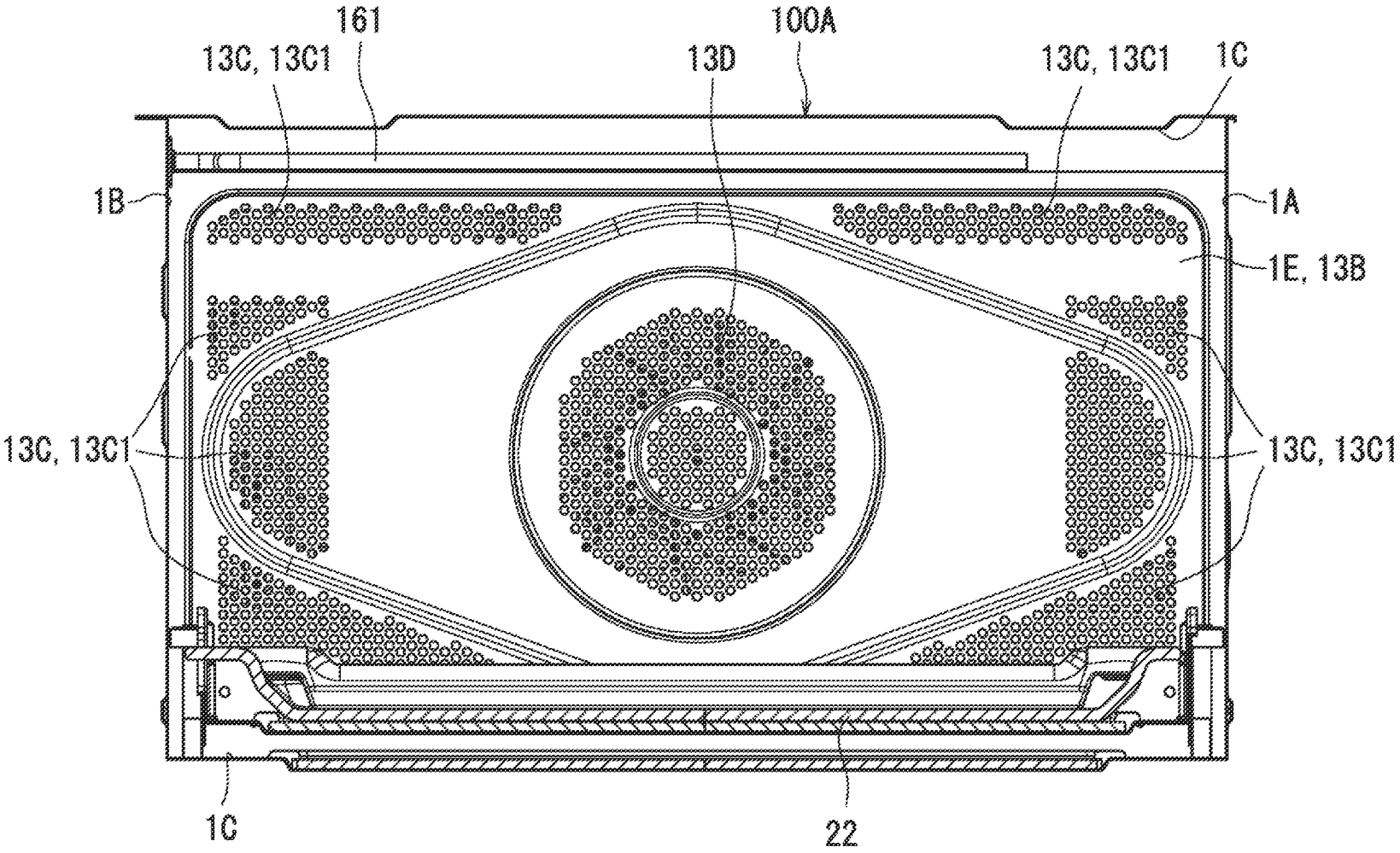
FIG. 8 is a front view illustrating the heating cooking chamber according to the present embodiment.

Next, the second air sending unit 13 according to the present embodiment will be further described. FIG. 8 is a front view illustrating the heating cooking chamber 100A according to the present embodiment.

More specifically, the second suction hole portion 13D is, for example, a set of a plurality of punched holes. Similarly, the second blow-out hole portion 13C is, for example, a set of a plurality of punched holes. The punched holes each have, for example, a circular shape. The diameter of each of the punched holes of the second suction hole portion 13D and the second blow-out hole portion 13C is, for example, 3.4 mm. Each of the second suction hole portion 13D and the second blow-out hole portion 13C has a small size. As a result, it is possible to prevent a tool or the like from being caught in the second suction hole portion 13D and the second blow-out hole portion 13C when the heating cooking chamber 100A is cleaned.

More specifically, the second blow-out hole portion 13C is disposed along the outer circumference of the second partitioning member 13B. The distance between the first blow-out hole portion 14C and the first suction hole portion 14D is shorter than the distance between the second blow-out hole portion 13C and the second suction hole portion 13D. Specifically, the second suction hole portion 13D is positioned at the center portion of the second partitioning member 13B. The set of the plurality of punched holes of the second suction hole portion 13D has, for example, a circular shape. On the other hand, the second blow-out hole portion 13C includes peripheral blow-out holes 13C1. The peripheral blow-out holes 13C1 are positioned at peripheral edge portions along the edge of the back wall 1E. Note that the distance between the blow-out hole portion and the suction hole portion refers to the distance between the center of the suction hole portion and the blow-out hole farthest from the center of the suction hole portion.

According to the pull-out heating cooking apparatus 100 of the present invention, the second blow-out hole portion 13C is disposed along the outer circumference of the second partitioning member 13B, and thus the inside of the heating cooking chamber 100A can be more uniformly heated.

In addition, the second centrifugal fan 132 opposes the second space 140 through the second partitioning member 13B. The second suction hole portion 13D opposes the second centrifugal fan 132.

As illustrated in FIG. 5 and FIG. 6, the pull-out heating cooking apparatus 100 further includes a grill unit 16. Specifically, the grill unit 16 includes a heating cooking heater 161 and an energization unit 162. The heating cooking heater 161 is positioned in the first space 130 and heats the object H to be heated. More specifically, the heating cooking heater 161 is positioned in an upper portion inside the heating cooking chamber 100A. The heating cooking heater 161 has a substantial U-shape when viewed from the upper side to the lower side. In the present embodiment, three grill units 16 are disposed. The heating cooking heater 161 is, for example, a sheathed heater. The energization unit 162 is positioned outside of the left wall 1B. The energization unit 162 energizes the heating cooking heater 161. The energized heating cooking heater 161 generates heat.

According to the pull-out heating cooking apparatus 100 of the present invention, because the heating cooking heater 161 is positioned in the first space 130, the object H to be heated does not adhere to the heating cooking heater 161. Further, according to the pull-out heating cooking apparatus 100 of the present invention, because the heating cooking heater 161 is provided, the first hot air F1 can be heated not only by the first heater 141 but also by the heating cooking heater 161. As a result, the predetermined region EA in the heating cooking chamber 100A can be heated in a shorter period of time.

Figure 9:
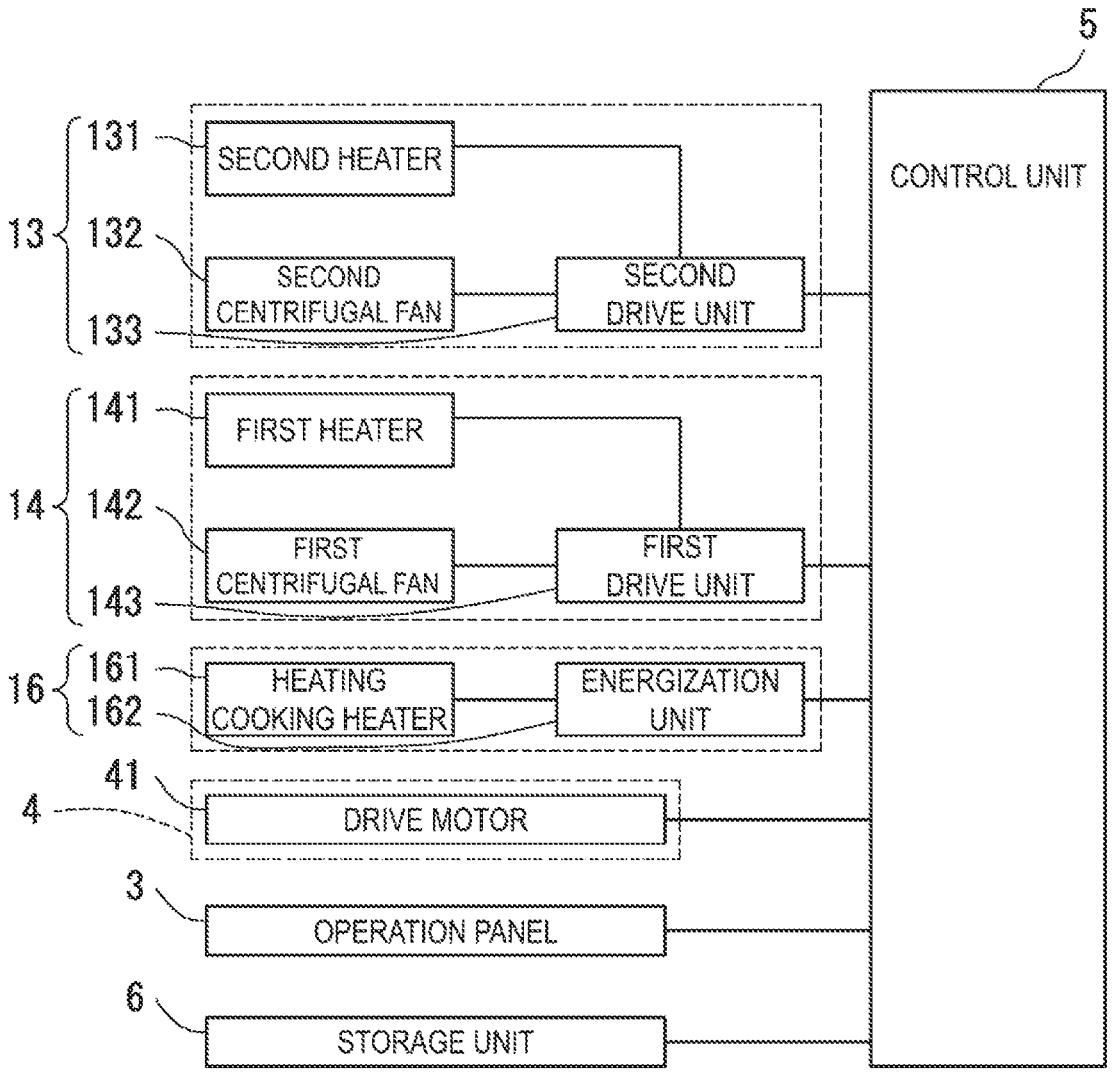
FIG. 9 is a block diagram illustrating a configuration of the pull-out heating cooking apparatus according to the present embodiment.

A configuration of the pull-out heating cooking apparatus 100 will be described in detail with reference to FIG. 9. FIG. 9 is a block diagram illustrating a configuration of the pull-out heating cooking apparatus 100 according to the present embodiment.

As illustrated in FIG. 9, the pull-out heating cooking apparatus 100 further includes a control unit 5 and a storage unit 6.

In the present embodiment, the pull-out heating cooking apparatus 100 has a "first hot air circulation heating mode", a "second hot air circulation heating mode", a "third hot air circulation heating mode", and a "grill heating mode" as heating cooking modes. The "first hot air circulation heating mode" is a mode in which the object H to be heated is heated and cooked by directly blowing the first hot air F1 onto an upper face of the object H to be heated. The "second hot air circulation heating mode" is a mode in which the predetermined region EA in the heating cooking chamber 100A is preheated in a short period of time by circulating the first hot air F1 in the heating cooking chamber 100A. The "third hot air circulation heating mode" is mainly a mode in which the object H to be heated is heated and cooked by circulating the second hot air F2 in the heating cooking chamber 100A to make the temperature in the heating cooking chamber 100A uniform. The "grill heating mode" is mainly a mode in which the object H to be heated is heated and cooked by radiation by conducting heat generated by the heating cooking heater 161 to the object H to be heated.

The control unit 5 is a hardware circuit that includes a processor such as a central processing unit (CPU). The control unit 5 controls the first heater 141, the first drive unit 143, the second heater 131, the second drive unit 133, the electrification unit 162, the drive motor 41, the operation panel 3, and the storage unit 6 by executing control programs stored in the storage unit 6.

More specifically, the control unit 5 controls the driving of each of the first air sending unit 14 and the second air sending unit 13. For example, in a case where the "first hot air circulation heating mode" or the "second hot air circulation heating mode" is selected, the first drive unit 143 is driven. Specifically, the first drive unit 143 energizes the first heater 141 and drives the first centrifugal fan 142. As a result, the predetermined region EA in the heating cooking chamber 100A can be heated in a short period of time. Further, in a case where the "third hot air circulation heating mode" is selected, the second drive unit 133 is driven. The second drive unit 133 energizes the second heater 131 and drives the second centrifugal fan 132. As a result, the inside of the heating cooking chamber 100A can be heated in a short period of time.

The storage unit 6 includes a random access memory (RAM) and a read only memory (ROM). The storage unit 6 stores control programs used for controlling operations of each part of the pull-out heating cooking apparatus 100. The storage unit 6 stores setting information input when the operation panel 3 is operated.

Figure 10:
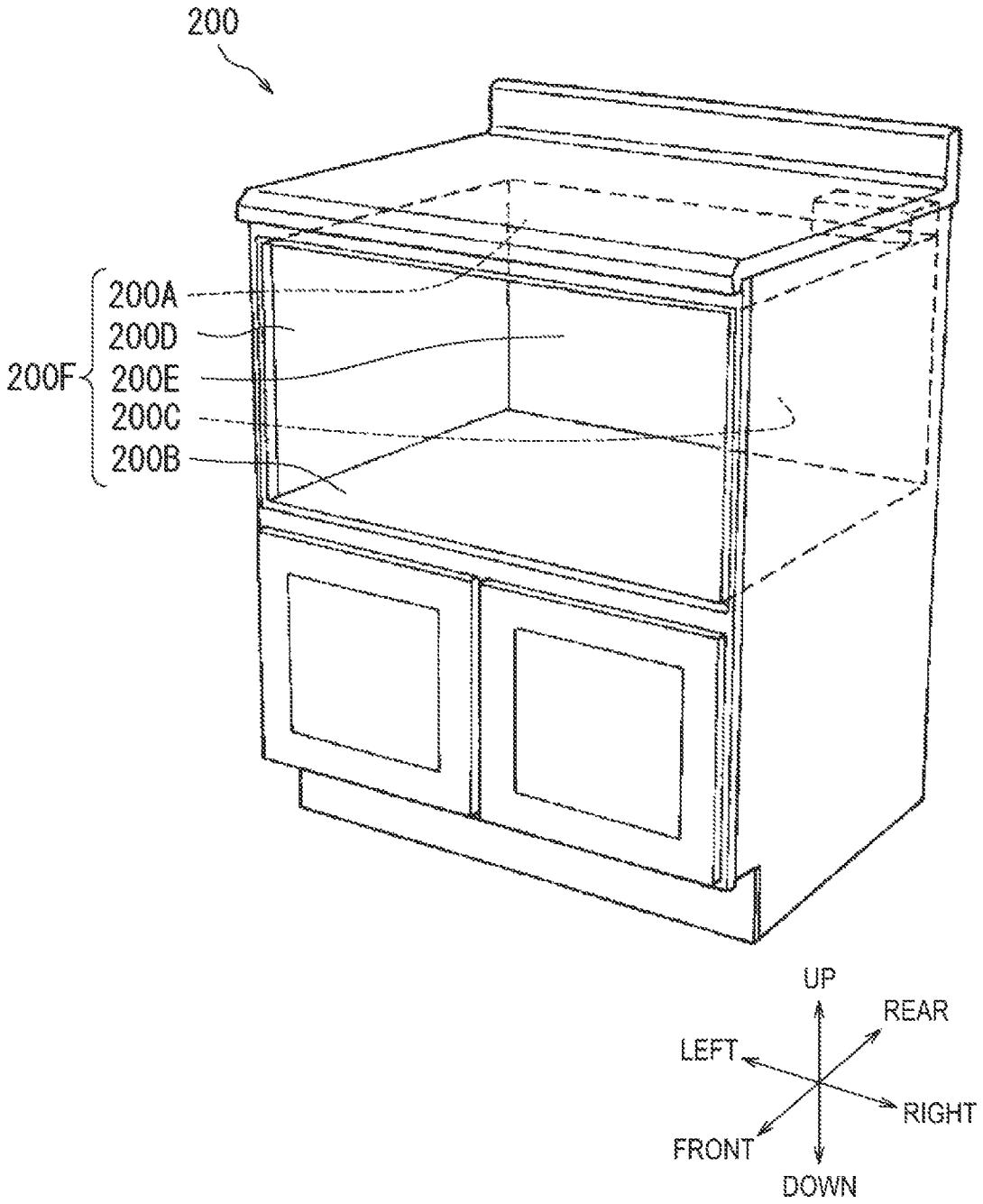
FIG. 10 is a perspective view illustrating the appearance of a cabinet to which the pull-out heating cooking apparatus according to the present embodiment is attached.

Next, a cabinet 200 to which the pull-out heating cooking apparatus 100 is attached will be described with reference to FIG. 10. FIG. 10 is a diagram illustrating an appearance of the cabinet 200 to which the pull-out heating cooking apparatus 100 according to the present embodiment is attached.

The pull-out heating cooking apparatus 100 is installed in the cabinet 200 in built-in manner. As illustrated in FIG. 10, the cabinet 200 includes an upper wall 200A, a lower wall 200B, a right wall 200C, a left wall 200D, and a rear wall 200E. The upper wall 200A, the lower wall 200B, the right wall 200C, the left wall 200D, and the rear wall 200E form an accommodation portion 200F. The accommodation portion 200F is a rectangular parallelepiped space into which the pull-out heating cooking apparatus 100 is fitted.

An embodiment of the present invention has been described above with reference to the drawings (FIG. 1 to FIG. 10). However, the present invention is not limited to the embodiment described above, and the present invention can be implemented in various modes without departing from the gist of the disclosure. The drawings primarily schematically illustrate each of the constituent elements for the sake of easier understanding, and the thickness, length, quantity, and the like of each of the illustrated constituent elements are different from the actual thickness, length, quantity, and the like by reason of creation of the drawings. The material, shape, dimensions, and the like of each of the constituent elements illustrated in the embodiment described above are merely exemplary and are not particularly limiting, and various modifications can be made within the scope not departing from the effects of the present invention in essence.

(1) As described with reference to FIG. 1 to FIG. 10, the pull-out heating cooking apparatus 100 includes the first air sending unit 14 and the second air sending unit 13, but the present invention is not limited thereto. For example, the pull-out heating cooking apparatus 100 may further include an air sending unit different from the first air sending unit 14 and the second air sending unit 13.

(2) The pull-out heating cooking apparatus 100 may include a microwave supply unit that supplies microwaves to the heating cooking chamber 100A.

(3) As described with reference to FIG. 1 to FIG. 10, each of the first blow-out hole portion 14C, the first suction hole portion 14D, the second blow-out hole portion 13C, and the second suction hole portion 13D is a set of a plurality of punched holes, but the present invention is not limited thereto. For example, each of the first blow-out hole portion 14C, the first suction hole portion 14D, the second blow-out hole portion 13C, and the second suction hole portion 13D may be one opening portion, may be a plurality of slit holes, or may be a net-like member.

(4) As described with reference to FIG. 1 to FIG. 10, the first hot air F1 blown from the first blow-out hole portion 14C moves downward, but the present invention is not limited thereto. For example, the first hot air F1 blown from the first blow-out hole portion 14C may move downward in a spiral manner with the first suction hole portion 14D serving as a central axis.

(5) As described with reference to FIG. 1 to FIG. 10, the pull-out heating cooking apparatus 100 includes the pull-out body 2, but the present invention is not limited thereto. For example, the pull-out heating cooking apparatus 100 may include a rotary table on the bottom wall 1D without including the pull-out body 2. In addition, the pull-out heating cooking apparatus 100 may have a rack. The rack is placed on the placing portion 22 of the pull-out body 2.

INDUSTRIAL APPLICABILITY

The present invention is useful in the field of a heating cooking apparatus, for example.

REFERENCE SIGNS LIST

1 Heating chamber
14 First air sending unit
14A First air sending chamber
14B First partitioning member
14C First blow-out hole portion
14D First suction hole portion
141 First heater
142 First centrifugal fan
100 Pull-out heating cooking apparatus
100A Heating cooking chamber
120 Accommodation space
130 First space

The invention claimed is:

1. A pull-out heating cooking apparatus comprising:

a heating cooking chamber including an accommodation space configured to accommodate an object to be heated, a space communicating with the accommodation space, and a top wall;

an air sending unit configured to supply hot air to the accommodation space;

a heating cooking heater disposed in the space; and a pull-out body on which the object to be heated is to be placed, wherein the heating cooking chamber includes an opening that communicates with outside of the heating cooking chamber, the air sending unit includes:

an air sending chamber;

a partitioning member positioned between the space and the air sending chamber;

a suction hole portion disposed in the partitioning member and configured to suction air from inside the heating cooking chamber;

a heater; and a blow-out hole portion disposed in the partitioning member and configured to blow air into the heating cooking chamber, the space is defined by the top wall, the space is located above an upper end of the opening of the heating cooking chamber and between the accommodation space and the air sending unit, such that the object to be heated is kept out of contact with the heating cooking heater while the pull-out body is moved into the accommodation space, a lower end of a part of the top wall that is in front of the top wall is located lower than the heating cooking heater, the heating cooking heater is located below the air sending unit, and the heater is located in the air sending chamber.

2. The heating cooking apparatus according to claim 1, wherein the heating cooking heater is disposed below an area where the blow-out hole portion is disposed.

3. The pull-out heating cooking apparatus according to claim 1, wherein the heating cooking heater heats the hot air supplied to the accommodation space from the first-blow-out hole portion and heats the object by radiation.

* * * * *